US005104183A

United States Patent [19]

Madsen et al.

[11] Patent Number: 5,104,183

[45] Date of Patent: Apr. 14, 1992

[54] ROTATABLE SEAT

[75] Inventors: Joe E. Madsen, Leominster; Mark W. Wheeler, Marblehead, both of Mass.

[73] Assignee: Moduform, Inc., Fitchburg, Mass.

[21] Appl. No.: 640,710

[22] Filed: Jan. 14, 1991

[51] Int. Cl.[5] ..... A47B 39/00

[52] U.S. Cl. ..... 297/142; 297/349

[58] Field of Search ..... 297/140, 141, 142, 170, 297/172, 337, 349

[56] References Cited

U.S. PATENT DOCUMENTS

| | | | |
|---|---|---|---|
| 508,961 | 11/1893 | Moss | 297/142 |
| 536,577 | 3/1895 | Mallett | 297/142 |
| 4,977,848 | 12/1990 | Currey | 297/349 X |

*Primary Examiner*—Laurie K. Cranmer

*Attorney, Agent, or Firm*—Hamilton, Brook, Smith & Reynolds

[57] ABSTRACT

A rotatable seat with a sealed rotating member for use in a prison.

23 Claims, 2 Drawing Sheets

ROTATABLE SEAT

DESCRIPTION

1. Background of the Invention

Rotatable or swing arm seating is sometimes required due to space constraints as may be found, for example, in correctional institutions. Such requirements may also include stops to limit the travel of the arm and tamper resistant hardware, as may be required for the installation of the seating. Further, constraints due to safety considerations, such as protruding parts, sharp edges, pinch points and the like, must also be taken into account in the fabrication of seating for correctional institutes.

2. Summary of the Invention

This invention relates to a seat attached to a post which is in turn attached to a floor and to a framework attached to a wall and wherein the seat is rotatable about the axis of the post. In particular, this invention relates to the method of hinging the seat and the attachments thereof to the floor and the table.

The present invention provides a safe, durable mechanism which integrates the safety, tamper resistant, and durability requirements of swing arm seating. The invention comprises a seat rotatable about a vertical hollow post having upper and lower ends. A set of roller bearings is provided at each end of the post. The lower end of the post is attached to a base by means of a stud extending through and affixed to the inner race of the lower bearing. A rod extends along the longitudinal axis of the post and through the inner race of the upper bearing and is attached at a lower end of the rod to the stud by a nut. The upper end of the rod is attached by a nut.

This arrangement permits the post to rotate about its longitudinal axis. A seat is connected to the axially rotatable post. A spacer is provided between the base and lower end of the post sealing that portion of the post. Thus, the interior of the post containing the pivoting structures cannot be harmed by cleaning fluids. Also, those interior elements cannot be accessed and misused by inmates.

A table with a cavity securely covers the upper end of the post and prevents unauthorized access.

The above and other features of the invention, including various novel details of construction and combinations of parts will now be more particularly described with reference to the accompanying drawings and pointed out in the claims. It will be understood that the particular device embodying the invention is shown by way of illustration only and not as a limitation of the invention. The principles and features of this invention may be employed in varied and numerous embodiments without departing from the scope of the invention.

DETAILED DESCRIPTION OF THE PREFERRED EMBODIMENTS

The rotatable seat system of the present invention is intended for use in correctional institutions or for like duty in other applications requiring durability, safety and ease of maintenance.

Figure 1:
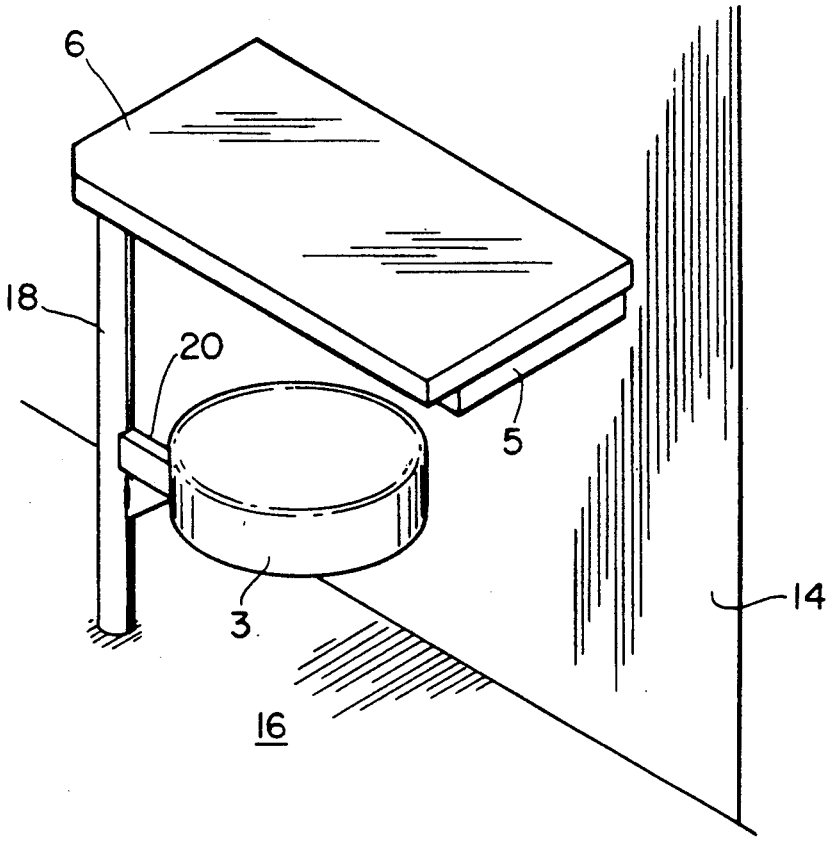
FIG. 1 is a perspective view of a swinging arm seating system with a writing surface, according to the present invention.

FIG. 1 illustrates a preferred embodiment of the present invention, wherein a wooden or metallic writing surface 6 is bolted on a rectangular frame 5 which is, in turn, bolted to wall 14 using conventional tamper-proof hardware (not shown). A vertical, hollow, cylindrical post 18 is coupled to seat 3 by strut 20 which is welded to post 18 and seat 3. Post 18, as will be described in connection with FIG. 2, is axially rotatable which allows seat 3 to move radially about the longitudinal axis of post 18, thereby allowing adjustment and storage of the seat 3 in relation to writing surface 6.

Figure 2:
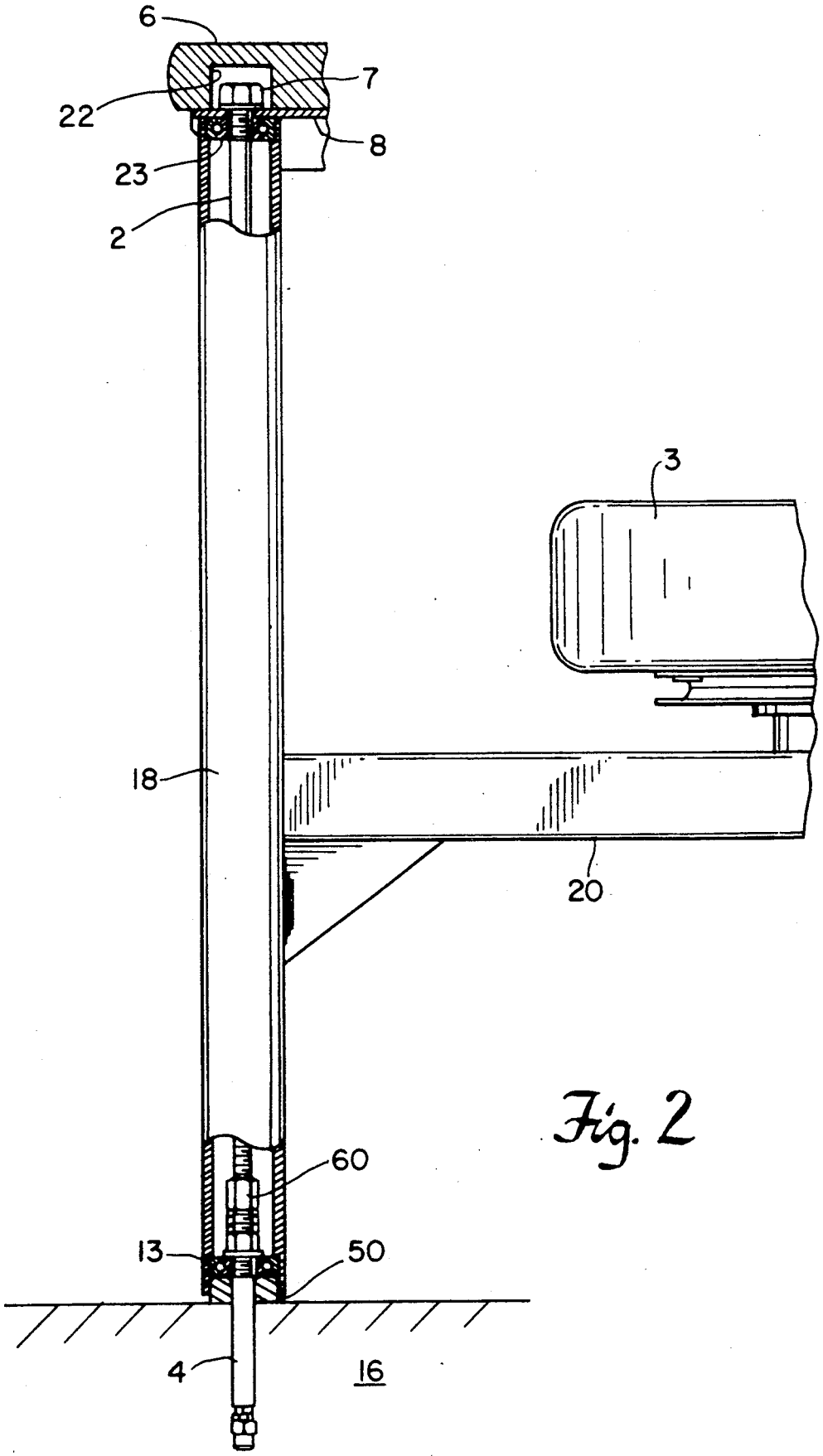
FIG. 2 is a cross-sectional view of the embodiment of the present invention.

FIG. 2 is a cross-sectional view illustrating, in more detail, the method of support and rotation of post 18. Post 18 is hollow and is relieved on both ends to capture the outer races of tapered roller bearings 13 and 23 which are preloaded by tension from threaded connecting rod 2 which passes through transverse openings formed in the inner race of bearings 13 and 23. Connecting rod 2 extends along the longitudinal axis of post 18 from nut 7 through frame 8 to nut 6 connected to floor mounted stud 4. A spacer 50 between the inner race of lower bearing 13 allows normal washing and cleaning of the floors while preventing liquids from entering the bearing area. Table top 9 is relieved in a manner such that a cavity 22 is formed over nut 7 which is captured and is not adjustable after installation without removing table top 6.

The method of construction of the rotatable seat is simple. First, stud 4, shown in FIG. 2, is secured in floor 16 which serves as a base. A threaded portion of stud 4 extends from the base. A planar circular spacer 50 with a transverse opening is placed over the stud and positioned adjacent floor 16. A lower tapered bearing 13 with inner and outer races and a transverse opening is placed over stud 4 adjacent the spacer 50. Next, a threaded rod 2 is attached to stud 4 by means of nut 60. A hollow, cylindrical post 18 with a cantilevered seat 3 is placed over rod 2 and attached to bearing 13 by means of a recessed diameter at its end so as to cover spacer 50 and prevent cleaning fluids from accessing the bearing housing. An upper tapered bearing 23 is placed at the other end of post 18. Finally, a hole in frame 8 is placed over the upper tapered bearing 23, post 18, and connecting rod 2. The assembly is secured by nut 7. The frame 8 and nut 7 are covered by a work surface 6 which has a cavity 22 to conform to the shape of nut 7. Thus, seat 3 rotates about post 18 which is sealed and tamper proof.

Equivalents

Those skilled in the art will recognize, or be able to ascertain, using no more than routine experimentation, many equivalents to the specific embodiments of the invention described herein.

These and all other equivalents are intended to be encompassed by the following claims.

We claim:

1. A rotatable seat comprising:

a) a vertical hollow post having an upper end and a lower end;

b) a stud attached to a base;

c) a first bearing coupled to said stud and said lower end of said post to permit said post to rotate;

d) a seat connected to said rotatable post;

e) a secure, integral cover coupled to said upper end of said post to seal said upper end;

f) a second bearing attached to the upper end of said post;

g) a connecting rod with a first end and a second end;

h) the first end of the rod coupled to said stud and the second end exiting said post upper end, coaxial to said second bearing; and i) a nut attached to said rod second end; wherein said cover also seals said nut, rod, second bearing, and post.

2. A rotatable seat, as recited in claim 1, further comprising said post lower end completely covering said bearing.

3. A seat, as recited in claim 1, wherein said cover further comprises a writing surface.

4. A seat comprising:

a) a vertical hollow post rotatable about its axis including a first end and a second end;

b) a stud attached to a base;

c) a first bearing coupled to said stud and said first end of said post to permit said post to rotate with the first end of the post completely covering the bearing;

d) a seat connected to said post; and e) a secure, integral cover including a horizontal table with a cavity coupled to said second end of said post to seal said post second end.

5. A seat, as recited in claim 4, wherein said cover further comprises a writing surface.

6. A seat, as recited in claim 4, wherein said first bearing and second bearing are roller bearings.

7. A seat, comprising:

a) a vertical hollow post rotatable about its axis including a first end and a second end;

b) a stud attached to a base;

c) a first bearing coupled to said stud and said first end of said post to permit said post to rotate with the first end of the post completely covering the bearing;

d) a seat connected to said post; and e) a secure, integral cover including a horizontal table with a cavity coupled to said second end of said post to seal said post second end f) a second bearing attached to said post second end;

g) a connecting rod with a first end and a second end;

h) said rod first end coupled to said stud and said rod second end exiting said post second end, coaxial to said second bearing; and i) a nut attached to said rod second end;

j) wherein said cover seal said nut, rod, second bearing, and post.

8. A seat comprising:

a) a vertical, hollow, cylindrical post including a first end and a second end;

b) a stud attached to a floor;

c) a first roller bearing coupled to said stud and said first end of said post to permit said post to rotate;

d) a spacer positioned between the bearing and the floor; said post completely covering said bearing;

e) a cantilever strut including a first end and a second end, said cantilever strut first end is attached to said post;

f) a seat coupled to said cantilever strut second end;

g) a connecting rod, including a first end and a second end, said rod first end coupled to said stud, said rod is coaxial with the post and exits said post's second end;

h) a second roller bearing coupled to the interior of the post second end; said first and second roller bearings are coaxial with the post and the rod;

i) a nut, attached to said rod second end; and j) a table, including a writing surface and a cavity; said table is fixed to a wall so that the table cavity seals the nut and second roller bearing.

9. A method of forming a tamper-proof rotatable seat comprising the steps of:

a) securing a stud in a base with a threaded portion of the stud extending from the base;

b) providing a planar circular spacer with a transverse opening and placing the spacer over the stud and adjacent the base;

c) providing a lower tapered bearing with the inner and outer races and a transverse opening and placing said bearing over said stud and adjacent the spacer;

d) securing a lower end of a threaded rod to the stud by a first nut;

e) providing a hollow cylindrical post with a cantilevered seat affixed thereto and with a recessed diameter at each end and placing said post over said rod and securing the outer race of the lower tapered bearing in the recess at one end of the post;

f) placing an upper tapered bearing with inner and outer races and a transverse opening over an upper end of said rod and securing the outer race of the upper bearing in the remaining recessed inner diameter at the end of the post;

g) securing the rod to the inner race of the upper bearing by a second nut; and h) covering the second nut by a work surface layer with a cavity.

10. A method, as recited in claim 9, wherein said lower tapered bearing and said upper tapered bearing further comprise roller bearings.

11. A method, as recited in claim 9, wherein said work surface layer further comprises a writing surface.

12. A method, as recited in claim 9, wherein said rod is under tension and said post is under compression.

13. A method, as recited in claim 9, wherein said end of said post secured to said lower tapered bearing covers a portion of said spacer to prevent access to the post interior.

14. A method of forming a tamper proof rotatable seat comprising the steps of:

a) securing a stud in a base with a portion of the stud extending from the base;

b) providing a lower rotating element and coupling said lower rotating element to said stud;

c) securing a rod to said stud;

d) providing a hollow cylindrical post and placing said post over said rod and securing one end of the post to said lower rotating element such that said post is rotatable;

e) placing an upper rotating element on an upper end of said rod and securing said upper rotating element to an end of the post;

f) sealing the upper and lower rotating elements from exterior access; and g) attaching a seat to said rotatable post so that said seat can be moved and the interior portions of the rotatable post cannot be accessed.

15. A method, as recited in claim 14, further comprising the step of positioning a spacer between the base and the lower rotating element.

16. A method, as recited in claim 14, wherein the rod and the portion of the stud extending from the base are threaded.

17. A method, as recited in claim 14, wherein the lower and upper rotating elements are bearings.

18. A method, as recited in claim 14, wherein the rod is secured to the stud by a nut.

19. A tamper proof rotatable seat comprising a stud secured in a base with a portion extending from the base, a first rotatable element connected to said stud, a rod connected to said stud, a hollow cylindrical post covering said rod and a first end of said post connected to said first rotatable element, a second rotatable element connecting a second end of said post to said rod, and a secured covering at the second end of said post and rod wherein a seat is attached to said post which can not be accessed.

20. The apparatus, as recited in claim 19, further comprises a work surface which covers and seals said second end of said post.

21. A tamper proof rotatable seat comprising a stud secured in a base with a portion extending from the base, a bearing connected to said stud, a rod connected to said stud, a hollow cylindrical post covering said bearing, second bearing connecting the opposite ends of said rod and said post, and a secured covering at said opposite end of said post and rod wherein a seat is attached to said post such that the interior of said post can be moved and not be accessed.

22. The apparatus, as recited in claim 21, wherein the seat further comprises a spacer between the base and the bearing.

23. A tamper proof rotatable seat comprising:

a stud in a base;

a spacer positioned on said stud and adjacent said base;

a lower bearing positioned on said spacer;

a threaded rod;

a first nut connecting said rod to said stud;

a hollow cylindrical post with a seat affixed thereto;

said post positioned over said rod and a first end of said post is connected to said lower bearing;

an upper bearing coupled to said rod and a second end of said post; and a covering which seals the second end of the post.

* * * * *